United States Patent [19]

Nara et al.

[11] Patent Number: 4,840,439

[45] Date of Patent: Jun. 20, 1989

[54] DISPLAY CABINET

[75] Inventors: Kenichi Nara; Ryoichi Takahashi, both of Maebashi, Japan

[73] Assignee: Sanden Corporation, Gunma, Japan

[21] Appl. No.: 201,323

[22] Filed: May 24, 1988

Related U.S. Application Data

[63] Continuation of Ser. No. 20,088, Feb. 27, 1987, abandoned.

[30] Foreign Application Priority Data

Mar. 3, 1986 [JP] Japan ..... 61-30215[U]
Mar. 3, 1986 [JP] Japan ..... 61-30216[U]

[51] Int. Cl.[4] ..... E05B 65/46

[52] U.S. Cl. ..... 312/116; 211/59.3; 312/72

[58] Field of Search ..... 312/347, 346, 71, 236, 312/116, 34, 137; 108/27; 211/59.3

[56] References Cited

U.S. PATENT DOCUMENTS

| | | | |
|---|---|---|---|
| D. 47,441 | 6/1915 | Ullin | 312/116 X |
| D. 156,416 | 12/1949 | Greiling | D80/11 |
| 2,098,844 | 11/1937 | Waxgiser | 211/59.3 |
| 2,321,695 | 6/1943 | Miller | 42/89.5 |
| 2,756,570 | 7/1956 | Gale | 62/141 |
| 2,836,039 | 5/1958 | Weber | 62/89.5 |
| 2,932,955 | 4/1960 | Hargrave et al. | 62/255 |
| 3,907,117 | 9/1975 | William | 211/7 X |
| 4,067,444 | 1/1978 | Wilson | 211/4 X |
| 4,632,446 | 12/1986 | Douglass | 312/216 X |
| 4,744,611 | 5/1988 | Tamura et al. | 312/116 |

FOREIGN PATENT DOCUMENTS

| | | |
|---|---|---|
| 1277363 | 10/1960 | France . |
| 2163244A | 2/1986 | United Kingdom . |

*Primary Examiner*—Joseph Falk
*Attorney, Agent, or Firm*—Banner, Birch, McKie & Beckett

[57] ABSTRACT

The present invention is directed to a display cabinet provided with a compartment. The compartment is divided into at least two spaces by a shelf for storing and displaying merchandise. The shelf is provided with a frame element which is slidably supported thereon. The frame element is supported on the shelf with a gap therebetween and determines the storage space for merchandise when the frame is placed in its normal position. When the frame element is pulled forward, the merchandise on the shelf is gathered by the frame and pushed to the front of the shelf for easy access. This also forms a space for loading additional merchandise in the back of the shelf. A stopper element is disposed at the front of the shelf to prevent merchandise from falling off the shelf when the frame element is pulled forward.

21 Claims, 5 Drawing Sheets

DISPLAY CABINET

This application is a continuation of application Ser. No. 020,088, filed Feb. 27, 1987, now abandoned.

TECHNICAL FIELD

The present invention relates to merchandise display cabinets. More particularly, the present invention relates to a shelf structure for storing and displaying merchandise disposed within a storage/display chamber of a merchandise display cabinet.

BACKGROUND OF THE INVENTION

In conventional merchandise display cabinets, such as those used to display frozen food, beverage cans, and other items, transparent glass windows are used to increase the visibility of the merchandise in the display case. A plurality of shelves or plates divides the display cabinet into a plurality of display/storage chambers. The display cabinet may also be divided into two chambers, each of which is maintained at a different temperature. Therefore, several kinds of merchandise, each having different preservation temperatures, can be stored within the display/storage chambers of the same case at the same time.

In one prior structure of display cabinet, the storage/-display chamber is divided into two chambers, such as a freezing or refrigerating chamber and a heating chamber. The refrigerating chamber is refrigerated by a refrigerating unit disposed in a lower portion of the display cabinet. The heating chamber is heated by a flat plate heater disposed on the upper surface of the shelves. The two chambers can be connected to one another by a controllable sealing mechanism to form a single refrigerating chamber.

In these display structures, a glass door is disposed on one side of the display cabinet to close the cabinet opening, maintain the desired temperature, and facilitate loading and removing merchandise. Customers normally remove merchandise placed just behind the door in the front of the storage/display chamber. Therefore as the stored merchandise supply depletes, the customer must reach further into the chamber to remove the merchandise positioned in the back of the chamber, and it is often difficult to reach this merchandise.

Furthermore, when the number of items of stored merchandise is reduced, additional merchandise should be loaded into the storage/display chamber. However, if the additional merchandise fills up the open space in the front of the chamber, the merchandise disposed in the back of the chamber is never removed. To remedy this, merchandise in the inner part of the chamber should be removed before new merchandise is loaded into the storage/display chamber, and older merchandise should be placed in the front of the chamber to be easily removed by the customer. However, this merchandise rotating operation is very time consuming.

SUMMARY OF THE INVENTION

It is accordingly a primary object of this invention to provide a display cabinet with an improved shelf which better facilitates removal therefrom of merchandise by the customer and which better facilitates rotating new and old merchandise by the operator.

It is another object of this invention to provide a display cabinet which achieves the above object and is simple in construction.

A display cabinet in accordance with the present invention includes a compartment for storage and display of merchandise. The compartment is defined by three side windows, a top plate portion, a bottom portion and at least one hinged door. Preferably, the display cabinet includes at least one partition plate disposed within the display compartment to divide the compartment into two chambers. Storage/display space for merchandise is defined by the partition plate and/or at least one shelf disposed within each chamber. A rectangular frame element is slidably supported on the shelves, and on the partition plate if it is used as a shelf, at a set distance above the top surface of the shelves. Merchandise in the back of the chamber is easily removed from the cabinet by sliding the frame element forward which motion pushes merchandise to the front of the chamber.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENT

Figure 1:
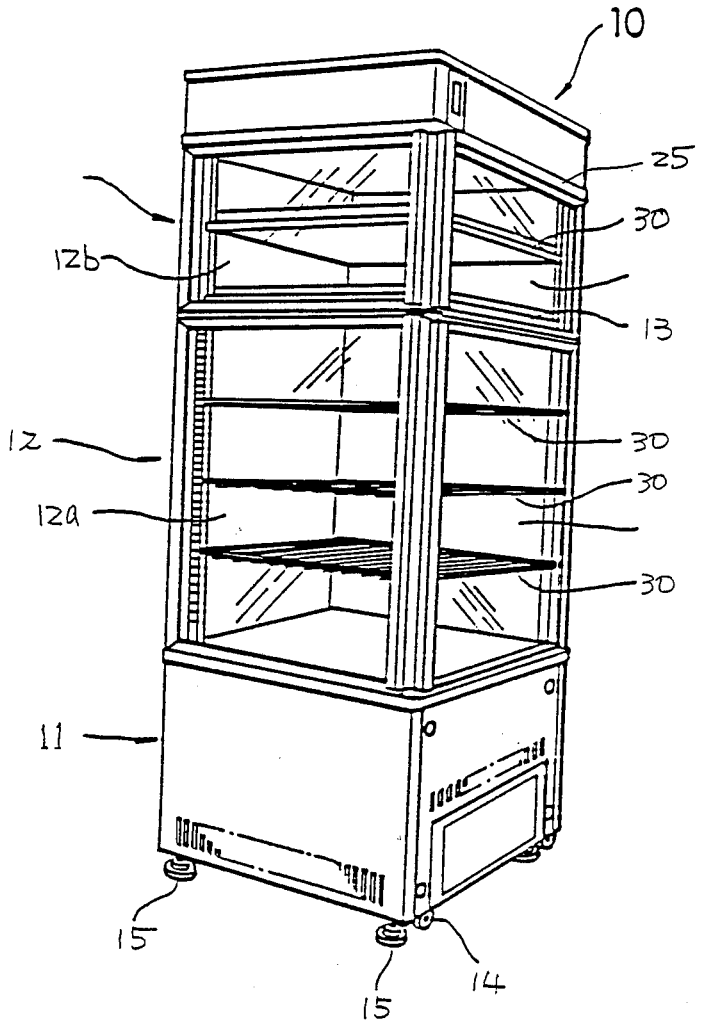
FIG. 1 is a perspective view of a frame of a display cabinet of the present invention.

Referring to FIG. 1, a display cabinet in accordance with one embodiment of the present invention is indicated generally by reference number 10. Display cabinet 10 includes mechanical chamber 11 within which a refrigerating unit is disposed, and merchandise display compartment shown generally at 12 disposed above mechanical chamber 11. Display compartment 12 is divided into freezing or refrigerating chamber **12*a* and heating chamber 12*b* by partition plate 13. Each chamber is maintained at a desired predetermined temperature by operation of the refrigerating unit and the heating equipment. Flat plate heat element 16 is positioned on the upper surface of partition plate 13 and heats heating chamber 12*b*. In an alternative embodiment, heating chamber 12*b* can communicate with refrigerating chamber 12*a* through a gap (not shown) between partition plate 13 and windows (not shown) which may be normally sealed by a sealing mechanism (not shown). Thus, heating chamber 12*b* can be used as a refrigerating chamber by opening the sealing mechanism. This embodiment is shown in our copending patent application Ser. No. 847,522 filed on Apr. 3, 1986, which issued as U.S. Pat. No. 4,744,611. Casters 14 for moving display cabinet 10 and locking legs 15 for fixing the position of cabinet 10 are disposed beneath mechanical chamber 11**.

Figure 2:
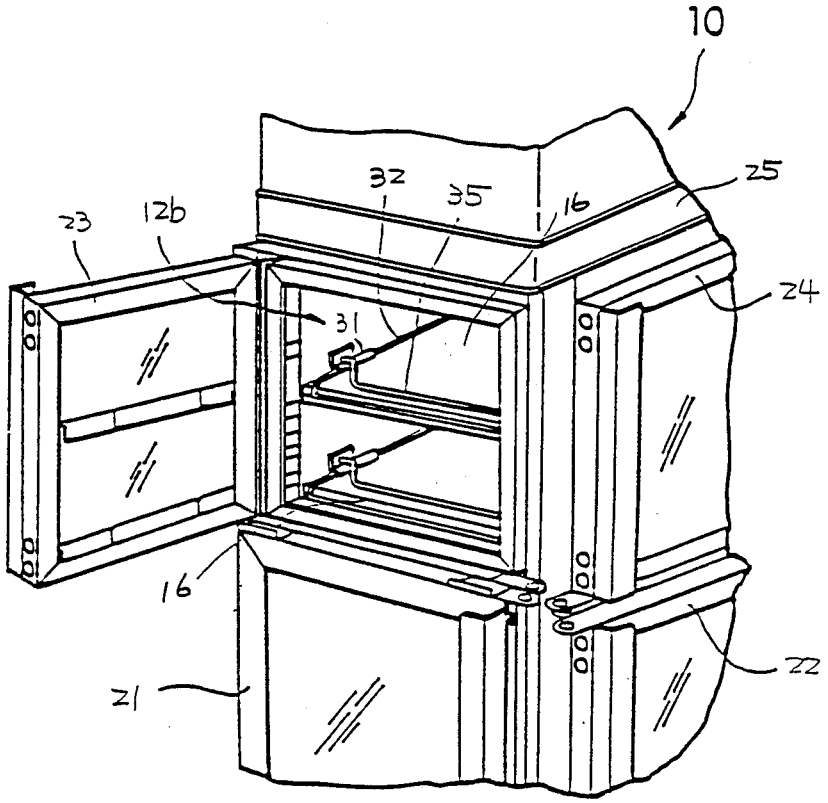
FIG. 2 is an enlarged perspective view of a portion of the display cabinet shown in FIG. 1.

Refrigerating chamber **12*a* and heating chamber 12*b* may be generally defined by three side windows, a top plate portion and a hinged door. As shown in FIG. 2, in the preferred embodiment of this invention, refrigerating chamber 12***a* is defined by two side windows (not shown), main hinged door 21 on the front opening of refrigerating chamber 12*a*, secondary hinged door 22 on the side opening of refrigerating chamber 12*a* and partition plate 13. Heating chamber 12*b* is defined by two side windows, one of which is indicated at 20, main hinged door 23 on the front opening of heating chamber 12*b*, secondary hinged door 24 on the side opening of heating chamber 12*b*, and top plate portion 25. Each pair of main and secondary hinged doors is supported on cabinet 10 for reverse hinging. That is, main hinged doors 21, 23 are supported on the cabinet 10 for rotation on the corner of display cabinet 10 opposite to the corner on which secondary hinged doors 22, 24 are supported for rotation. Therefore, the customer can easily access the stored merchandise from two sides, and rotating old and new merchandise is easily accomplished by opening both doors 21, 22 and 23, 24 of chambers 12*a*, 12*b*, respectively.

Figure 3:
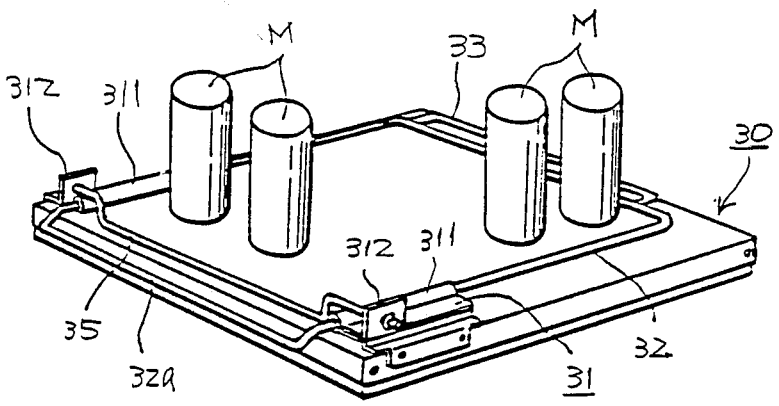
FIG. 3 is a perspective view of a shelf used in the display cabinet of FIG. 1.

At least one shelf 30 is disposed in each chamber 12*a*, 12*b* to define a plurality of display/storage spaces for merchandise. As shown in FIG. 3, each shelf 30 is provided with a pair of supporting devices 31. Supporting devices 31 are affixed on opposite side surfaces of shelf 30 adjacent main hinged doors 21, 23. Guide element 311 is formed on each supporting device 31 for slidably supporting rectangular frame element 32 which is formed of rods and has a shape slightly smaller than the outer configuration of shelf 30. Also, the range of sliding motion of frame element 32 is restricted by supporting device 31.

Frame element 32 can slide through guide element 311 of supporting device 31 toward the front opening when main hinged door 21, 23 is open. The front portion of frame element 32 is bent slightly downwardly to form grip portion 32*a*. Also, the rear portion of frame element 32 is provided with sub-frame element 33 which is supported on stopper plate 34 attached on the rear portion of shelf 30. The position of guide element 311 and the position of stopper plate 34 position frame element 32 above and parallel to shelf 30. The heights of guide element 311 and stopper plate 34 are chosen to elevate frame element 32 above shelf 30 a distance sufficient to prevent merchandise from tipping over when engaged by frame element 32.

In this construction of display cabinet 10, a plurality of merchandise M can be initially loaded on each shelf 30 from front opening and/or side-opening through main hinged door 21, 23 and/or secondary hinged door 22, 24, respectively. Frame element 32 is positioned on the upper surface of shelf 30 with a gap defined by supporting device 31, guide element 311 and stopper plate 34. Merchandise M is positioned within the space defined by frame element 32. The customer can remove the merchandise stored in chambers 12*a*, 12*b* of cabinet 10 through the front opening or the side opening after opening main or secondary hinged doors 21, 22, 23, 24. Preferably, merchandise is removed through main hinged doors 21, 23 only and merchandise is replaced through secondary hinged doors 22, 24.

Figure 5:
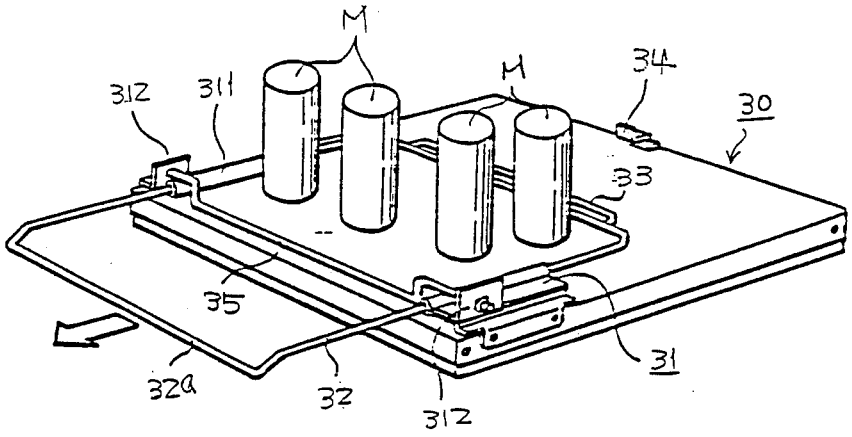
FIGS. 5, 6 and 7 are perspective views of the shelf illustrating the operation of the frame element thereof.
Figure 6:
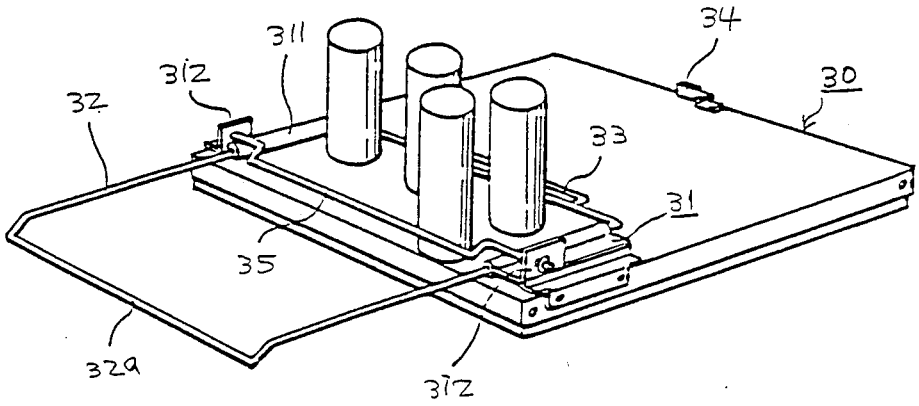
Figure 7:
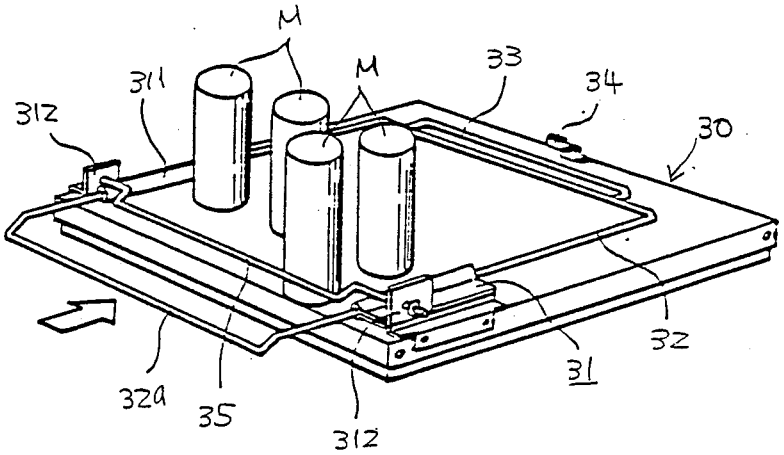

When almost all of merchandise M has been removed, the remaining merchandise M is usually positioned in the back of the display/storage space. Frame element 32 is slid outwardly along guide element 311 of supporting device 31 (in the direction of the arrow in FIG. 5). The rear portion of frame element 32 contacts the lower portion of the remaining merchandise M and pushes merchandise M toward the front of chamber 12*a*, 12*b*. Then, frame element 32 is pushed back to its rest position (in the direction indicated by the arrow in FIG. 7). Additional merchandise may be placed within the open space for storage within frame element 32. The older merchandise can also be easily placed adjacent the doors to further ensure that it is removed first. The new merchandise can be loaded in the open space within frame element 32 through the side opening and secondary hinged doors 22, 24.

Figure 4:
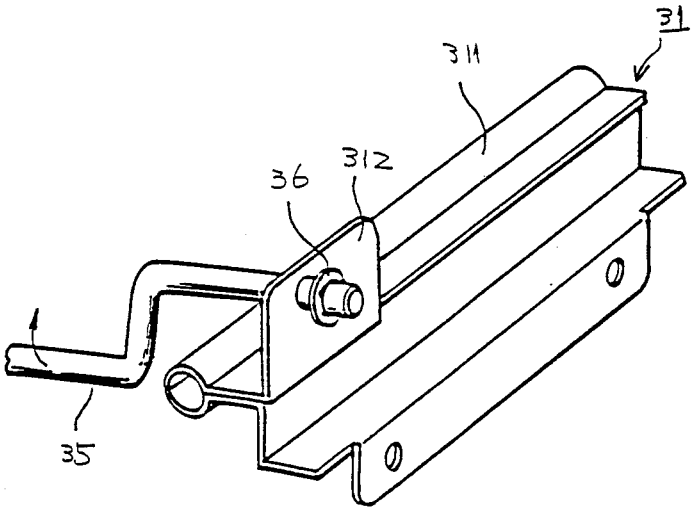
FIG. 4 is a perspective view of a supporting device for the shelf shown in FIG. 3.

As discussed above, the remaining merchandise M is easily moved to the front of chambers 12*a*, 12*b* by frame element 32; new loading space is also formed by the sliding operation of frame element 32. Merchandise M is normally prevented from dropping from shelf 30 by grip portion 32*a* of frame element 32. However, during the sliding operation of frame element 32, the front portion of shelf 30 is not protected. In other words the bar for preventing merchandise from falling is removed while frame element 32 is pulled forward. Therefore, a stopper element 35 is provided disposed on the front portion of shelf 30, as shown in FIGS. 3 and 4. Stopper element 35 comprises a rod element which is pivotably supported on supporting device 31, and has a U-shaped configuration. Both end portions of the rod element are supported on flange portion 312 of supporting device 31 and are restricted from axial movement by snap ring 36. When gathered merchandise contacts the rod element of stopper element 35, the rod element pivots to restrict the sliding movement of the merchandise. This positions the gathered merchandise at the front of the chamber and prevents the gathered merchandise from falling off of shelf 30.

Numerous characteristics and advantages of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. A display cabinet comprising:

at least one structural member defining a compartment for displaying and storing merchandise, said structural member including a door movable between open and closed positions, said door when in the open position providing access to merchandise stored in said compartment;

a shelf disposed in said compartment to provide a support surface for merchandise stored in said compartment, said shelf having a shelf back portion, a shelf front portion, a shelf first side portion, and a shelf second side portion opposite to said shelf first side portion;

a slideable rod rectangular frame element positioned a discrete distance above and parallel to said shelf to position the merchandise supported on said support surface of said shelf by sliding towards said shelf front portion and pushing merchandise therewith, the discrete distance being sufficient to prevent merchandise from tipping over when engaged and pushed relative to said shelf by said slideable rod rectangular frame element;

first and second spaced elongated sleeves through which said slideable rod rectangular frame element is slidably received;

a first support element fixing said first spaced elongated sleeve at said shelf first side portion;

a second support element fixing said second spaced elongated sleeve at said shelf second side portion, said first and second support elements positioning said first and second spaced elongated sleeves, respectively, so that said slideable rod rectangular frame element is positioned at the discrete distance relative to said shelf for sliding movement relative to said shelf; and a stopper element at said shelf back portion which holds, together with said first and second spaced elongated sleeves, said slideable rod rectangular frame element at the discrete distance when said slideable rod rectangular frame element is fully inserted in a stationary position in said compartment.

2. The display cabinet of claim 1 wherein said shelf has opposite first and second shelf side edges, said first support element being secured directly to said first shelf side edge, and said second support element being secured directly to said second shelf side edge.

3. The display cabinet of claim 1 wherein said shelf divides said compartment into upper and lower merchandise storage spaces.

4. The display cabinet of claim 1 wherein said slideable rod rectangular frame element includes a forward lateral hand grip portion.

5. The display cabinet of claim 1 wherein said slideable rod rectangular frame element includes spaced first and second side frame members, a rear frame member secured at opposite ends thereof to said first and second side frame members, and a subframe element which is secured to said rear frame member and which is directly engageable with said stopper element when said slideable rod rectangular frame element is in the stationary position.

6. The display cabinet of claim 1 wherein said slideable rod rectangular frame element encloses an area substantially equal to the total surface area of said shelf.

7. The display cabinet of claim 1 wherein said structural member comprises a front structure and a side structure, said door defining a first hinged door positioned at said front structure, and said structural member further comprises a second hinged door positioned at said side structure in a reverse hinging arrangement with said first hinged door.

8. The display cabinet of claim 1 wherein said compartment is divided into a first storage display chamber which is refrigerated and a second storage display chamber which is heated.

9. The display cabinet of claim 1 further comprising stopping means for preventing merchandise on said shelf front portion from falling off of the front of said shelf when said slideable rod rectangular frame element is pulled towards said shelf front portion.

10. The display cabinet of claim 9 wherein said stopping means includes a stopper bar and supporting means for pivotably supporting said stopper bar.

11. The display cabinet of claim 10 wherein said stopper bar is pivotal about said supporting means between a lower position and a raised position which prevents merchandise from falling off of the front of said shelf.

12. The display cabinet of claim 11 wherein said supporting means enables said stopper bar to automatically pivot from the lower position to the raised position when merchandise engages said stopper bar and is pulled forward by said slideable rod rectangular frame element.

13. The display cabinet of claim 10 wherein said supporting means is secured directly to said first and second support elements.

14. The display cabinet of claim 11 wherein said stopper bar, when in the raised position, does not block removal of merchandise on said shelf from said compartment through the space provided by said door when in the open position.

15. A display cabinet comprising:

at least one structural member defining a compartment for displaying and storing merchandise, said at least one structural member including a door movable between open and closed positions, said door when in the open position providing access to merchandise stored in said compartment;

a shelf disposed in said compartment to provide a support surface for merchandise stored in said compartment, said shelf comprising a shelf back portion, a shelf front, a shelf first side portion, and a shelf second side portion;

a slideable generally rectangular frame element positioned a discrete distance above and parallel to said shelf to position merchandise supported on said support surface by sliding towards said shelf front portion and pushing merchandise therewith towards said shelf front portion, the discrete distance being sufficient to prevent merchandise from tipping over when engaged and pushed relative to said shelf by said slideable generally rectangular frame element;

supporting structures at said first side shelf portion and said second side shelf portion for supporting said slideable generally rectangular frame element for sliding movement at the discrete distance;

a stopper element disposed generally at said shelf front portion for preventing merchandise from falling off of said shelf when said slideable generally rectangular frame element is pulled towards the front of said shelf; and a supporting means connected to said shelf for pivotably supporting said stopper element so that said stopper element automatically pivots when engaged by merchandise from a lower position to a raised position which is above the lower position and which is sufficiently high to prevent merchandise pushed by said slideable generally rectangular frame element from falling forwardly off of said shelf and is sufficiently low so as to not block removal of merchandise supported by said shelf from said compartment and through an opening provided by said door when in the open position.

16. The display cabinet of claim 15 wherein said supporting means is secured directly to said supporting structures.

17. The display cabinet of claim 15 wherein said stopper element when in the lower position is adjacent to and slightly above said shelf.

18. The display cabinet of claim 15 wherein said stopper element comprises a U-shaped bar.

19. The display cabinet of claim 15 wherein said slideable generally rectangular frame element encloses an area substantially equal to the total surface area of said shelf.

20. The display cabinet of claim 15 wherein said slideable generally rectangular frame element comprises a forward lateral hand grip portion.

21. The display cabinet of claim 15 wherein said supporting structures define supporting structure openings, and said slideable generally rectangular frame element comprises a rectangular elongated rod which passes slidably through said supporting structure openings.

* * * * *